United States Patent [19]

Sander et al.

[11] 4,098,640

[45] Jul. 4, 1978

[54] MANUFACTURE OF PAPER-LIKE AND TEXTILE-LIKE SHEETS

[75] Inventors: Bruno Sander, Ludwigshafen; Heinz Berbner, Moerlenbach; Rolf Steinberger, Schifferstadt; Eckhard Ropte, Ludwigshafen; Jenoe Kovacs, Bobenheim-Roxheim; Joachim Kunde, Frankenthal, all of Fed. Rep. of Germany

[73] Assignee: BASF Aktiengesellschaft, Ludwigshafen am. Rhein, Fed. Rep. of Germany

[21] Appl. No.: 727,583

[22] Filed: Sep. 28, 1976

[30] Foreign Application Priority Data

Oct. 1, 1975 [DE] Fed. Rep. of Germany ..... 2543816

[51] Int. Cl.[2] ..... D21F 11/00

[52] U.S. Cl. ..... 162/146; 162/157 R

[58] Field of Search ..... 162/146, 157 R; 260/37 N, 30.4 N, 78 TF; 264/205, 11, 14, 140

[56] References Cited

U.S. PATENT DOCUMENTS 2,999,788 9/1961 Morgan ..... 162/157 R 3,929,691 12/1975 Allard ..... 260/78 TF

FOREIGN PATENT DOCUMENTS 2,179,004 11/1973 France ..... 162/146

4,733,725 8/1972 Japan ..... 162/157 R

*Primary Examiner*—S. Leon Bashore

*Assistant Examiner*—Peter Chin

*Attorney, Agent, or Firm*—Keil Thompson

[57] ABSTRACT

The manufacture of paper-like and textile-like sheet materials by the use of fibrids which have been obtained by dissolving poly(amide-imide) resins in an organic solvent, mixing the resulting solution with a liquid which is a non-solvent for the polymer and introducing the resulting solution into a liquid precipitation medium while exposing it to shearing forces.

The present invention relates to the use, for the manufacture of paper-like and textile-like sheet materials, of novel fibrids, which have been obtained by dissolving poly(amide-imide) resins in an organic solvent, mixing the resulting solution with a liquid which is a non-solvent for the polymer and introducing the resulting solution into a liquid precipitation medium while exposing it to shearing forces.

7 Claims, 2 Drawing Figures

MANUFACTURE OF PAPER-LIKE AND TEXTILE-LIKE SHEETS

Figure 1:
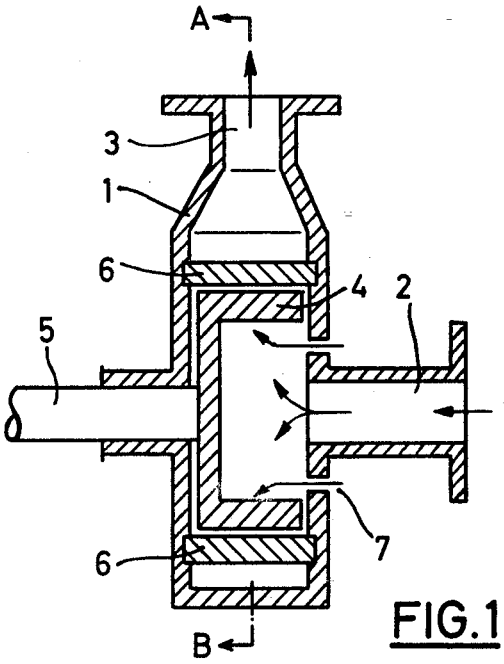

The fibrids and processes for manufacture thereof are disclosed and claimed in copending application Ser. No. 727,585, filed Sept. 28, 1976, by Bruno Sander, Kurt Scherling, Rolf Steinberger and Eckhard Ropte.

For the processing of synthetic fibrids in the conventional methods of paper and wet-laid nonwoven manufacture it is necessary that the synthetic fibrids should have the greatest possible tendency to form a web, i.e. that they should mat and interlace as intimately as possible with themselves or with other fiber products, for example cellulose fibers or staple fibers of synthetic polymers, so that a good fiber bond is achieved. For the manufacture of coherent, self-supporting webs on a paper machine from an aqueous suspension of the synthetic fibrids the webs obtained must have the highest possible initial wet strength. Furthermore, the webs must be capable of being readily removed again from the wire of the paper machine.

It is an object of the present invention to manufacture, from fibrids which consist of poly(amide-imide) resin, paper-like and textile-like sheets which, when manufactured into coherent, selfsupporting webs on a paper or wet-laid nonwoven machine, have an initial wet strength of at least 80 g.

This object is achieved by the use of fibrids which have been obtained by dissolving poly(amide-imide) resins in an organic solvent, mixing the resulting solution with a liquid which is a non-solvent for the poly(amide-imide) resin but is homogeneously miscible, in all proportions, with the organic solvent and a liquid precipitation medium, and introducing the resulting solution into a liquid precipitation medium whilst at the same time exposing it to shearing forces, and which have a length of from 0.1 to 5 mm, a thickness of from 5 to 200 $\mu$m, a freeness of from 20° to 90° SR and a specific surface area of from 1 to 80 $m^2/g$, for the manufacture of paper-like and textile-like sheets which have an initial wet strength of at least 80 g.

The fibrids defined above can, with advantage, be used in admixture with pulp and/or other natural or synthetic fibrous materials for the manufacture of paper-like sheets.

The sheets of paper and webs manufactured according to the invention are characterized by a good fiber bond, uniform formation and a surprisingly high initial wet strength, so that coherent, self-supporting webs or wet-laid nonwovens can be manufactured. The webs can be easily removed from the wire.

For the purposes of the invention, fibrids are fibrous particles of synthetic polymers which morphologically, in size and shape, and in their properties resemble cellulose fibers and/or beaten pulp.

The poly(amide-imide) resins are manufactured, for example, by reacting diimide-dicarboxylic acids with diisocyanates or diimidedicarboxylic acid chlorides eith diamines in accordance with German Laid-Open applications DOS. No. 2,425,666 and 2,441,020, and have the following general formula:-

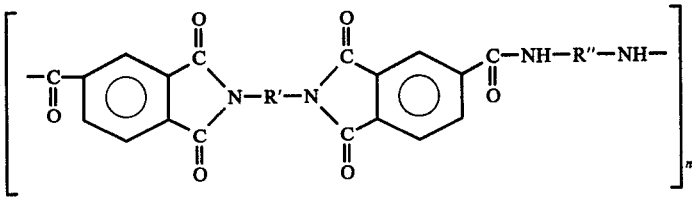

where the polymer may or may not contain additional amide linkages of the structure

—OC—R′—CO—NH—R″—NH— and where $n$ is an integer, R′ and R″ are identical or different, R′ and R″ are m- or p-phenylene or

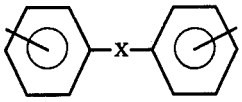

and $x$ is $CH_2$, O, S, CO or $SO_2$.

Solutions of the poly(amide-imide) resins in 1-methyl-2-pyrrolidone, N,N-dimethylformamide or N,N-dimethyl-acetamide are used as starting materials for the manufacture of the fibrids to be used according to the invention. These solutions in general have a solids content of from 5 to 35 and preferably from 15 to 25 percent by weight, and their viscosity is from 2,000 to 200,000 and preferably from 15,000 to 60,000 cP, measured by means of a falling ball viscometer.

These polymer solutions are admixed with a non-solvent for the polymer, for example a cyclic ether such as tetrahydrofuran or 1,4-dioxane. The cyclic ethers are admixed with the polymer solution in such an amount that the volume ratio of solvent to cyclic ether is from 1:1.5 to 1:5 and preferably from 1:2.5 to 1:4. The cyclic ethers are miscible in all proportions with the organic solvents proposed and with the liquid precipitation medium used, but the poly(amide-imide) resins are insoluble in the cyclic ethers.

Introduction of the solution of poly(amide-imide) resin, which additionally contains a non-solvent for the polymer, into a liquid precipitation medium is to be understood as rapid and thorough mixing of the said solution in a major amount of the liquid precipitation medium in a field of shearing forces, at room temperature. The volume ratio of polymer solution to precipitation medium may be from 1:5 to 1:100 and preferably from 1:10 to 1:20. Water is a particularly suitable precipitation medium.

The field of shearing forces is generated, in particular, by apparatuses which produce such a field mechanically by means of rotating tools. Commercial machinery which is used for dispersing and homogenizing, for instance, polymer dispersions, is suitable for this purpose. If the process is carried out batchwise, high speed mixers or Ultra-Turrax type apparatus which generates a field of shearing forces can be used.

The field of shearing forces can also be generated hydraulically. For example, if the solution of the polymers is expelled through one or more nozzles and if desired at the same time the liquid precipitation medium, travelling at a flow rate of at least 5 m/sec, is thoroughly mixed with the solution of the polymers in a field of shearing forces, fibrids are again obtained.

According to a special embodiment, the thorough mixing of the flowing media takes place in an impulse exchange chamber which is located downstream of, and concentrically with, the two-fluid nozzle. This apparatus is disclosed in German Laid-Open application No. 2,208,921.

In all variants of the process, stable, discrete fibrids are obtained directly. They can be separated from the liquid precipitation medium and from the greater part of the organic solvent and the non-solvent by filtering or centrifuging. The residual solvent is removed by washing with water on the filter or in the centrifuge. The organic solvents used, and the cyclic ethers, can be recovered by distillation from the mother liquor and from the wash water and be recycled to the process.

The fibrids obtained contain from 90 to 98 percent by weight of water and have a high sheet-forming or web-forming capacity when deposited on a wire from an aqueous suspension.

Aqueous suspensions of the fibrids to be used according to the invention are produced by introducing the fibrids into water, whilst stirring. The stock density is from 0.2 to 2% and preferably from 0.5 to 1%.

Papery sheet-like structures can be obtained from the aqueous suspensions of the fibrids, after appropriate further dilution with water, on a paper machine or wet-laid nonwoven machine.

The fibrids can also be mixed with cellulose fibers or with staple fibers of synthetic polymers in any desired ratio and the mixture can be processed on a paper machine to give self-supporting, coherent webs.

For the manufacture of coherent, self-supporting webs on a paper machine it is necessary that the webs should have a sufficiently high initial wet strength.

A standard sheet (2.4 g) which has been manufactured from fibrids must have an initial wet strength of at least 80 g at a water content of 83 percent by weight. Standard sheets prepared from the fibrids on a Rapid-Köthen sheet-forming apparatus have initial wet strengths of from 200 to 500 g.

Because of the strong tendency of the fibrids to form sheets and webs and the surprisingly high initial wet strength of the resulting sheets, the fibrids of poly(amide-imide) resins are particularly suitable for the manufacture of mixed webs with staple fibers of other fiber-forming polymers which are not themselves able to form webs. For example, staple fibers of high temperature-resistant polymers other than aromatic poly(amides), poly(amide-imides) and poly(imides) are used for the manufacture of mixed webs, so that high temperature-resistant and flame-retardant sheets are obtained which may be used for example as high temperature resistant insulators for the electrical industry or as flame-retardant textile sheets.

Figure 2:
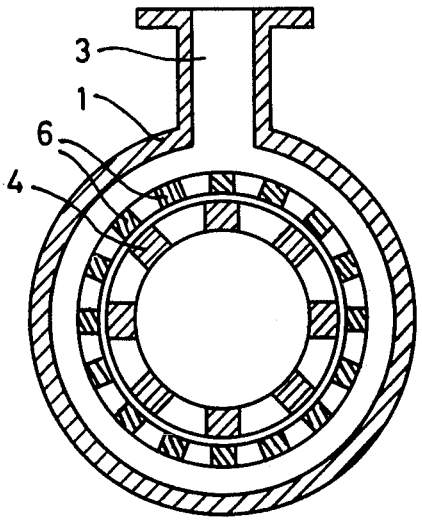

An embodiment of apparatus for conducting the process is illustrated in the drawing, wherein:

FIG. 1 is a diametric cross-section view of such embodiment and utilizes a rotor and ring-shaped stator; and FIG. 2 is a section view of the same apparatus, taken on section plane A-B of FIG. 1.

Measuring methods

The degree of fibrillation of the fibrids obtained was ascertained by determining the freeness by the Schopper-Riegler method (Korn-Burgstaller, Handbuch der Werkstoffprufung, 2nd edition, 1953, volume 4, Papier- und Zellstoffprufung, pages 388 et seq., Springer-Verlag). For this determination, the fibrids are introduced into an aqueous suspension of constant stock consistency (2 g/l and 20° C). The amount of water which is retained by the suspended fibrids under specific conditions is determined. The higher the degree of fibrillation of the fibrids, the greater is the amount of water absorbed (°Schopper-Riegler, °SR). The Schopper-Riegler values for an unbeaten sulfite cellulose are from 12 to 15 ° SR. By way of example, the Schopper-Riegler values for the fibrids used according to the invention are from 20 to 90 ° SR.

The draining time was also determined by the Schopper-Riegler method. In this method the run-off time in seconds of 700 ml of water from one liter of a 0.3 percent suspension of the material is measured.

The initial wet strengths are determined by means of the test instrument developed by W. Brecht and H. Fiebinger (Karl Frank, Taschenbuch der Papierprufung, 3rd enlarged edition, Eduard Roether Verlag, Darmstadt, 1958, page 59). Test strips of size 30 × 95 mm are produced from the fibrids to be tested on a laboratory sheetforming apparatus by inserting an appropriate frame. The thickness of the test strips (weight per unit area) is determined by the amount of pulp used. The load in *g* at which the test strip tears is then measured by means of the test instrument.

The tear lengths and elongations at break were determined according to DIN 53,112.

The specific surface area was determined by the BET nitrogen adsorption method (S. Brunauer, T.H. Emmett and E. Teller, J. Amer. Chem. Soc., 60 (1938), 309).

In the Examples, parts and percentages are by weight.

Manufacture of the Polymers 49.5 parts of 4,4'-diaminodiphenylmethane were dissolved in 627 parts of 1-methyl-2-pyrrolidone and 96 parts of trimellitic anhydride were added. After adding 125 parts of toluene, the theoretical amount of water was removed at from 140 to 150° C, and the toluene was recovered. On cooling the reaction mixture, the diimide-dicarboxylic acid precipitated in a well-crystallized form.

For the further conversion to the poly(amide-imide), the reaction batch was brought to 80° C and 62.5 parts of 4,4'-diphenylmethanediisocyanate were added. The temperature was then raised to 190° C at the rate of 10° C/30 minutes. The mixture was then cooled to 120° C and 1.25 parts of 4,4'-diphenylmethanediisocyanate were added twice more, at intervals of 1 hour. After 2 hours, a viscous poly(amide-imide) solution having a solids content of 22% and a solution viscosity of 34,600 cP (measured by means of a falling ball viscometer at 20° C) was produced. The intrinsic viscosity of the polymer was 0.81 dl/g (measured as a 0.5 percent strength solution in 1-methyl-2-pyrrolidone at 30° C).

Manufacture of the fibrids

The apparatus shown in FIG. 1 and FIG. 2 is used for the manufacture of the fibrids.

A housing 1 having a feed nozzle 2 and outlet nozzle 3 contains a rotor 4 which is driven by a shaft 5. This rotor 4 causes the liquid precipitation medium, which is present in the housing and is continuously fed in through the feed nozzle 2, to rotate. The kinetic energy of the rotor is thereby transferred to the liquid precipitation medium. The precipitation medium which has been accelerated is braked on an annular braking zone 6. The braking zone is formed by a ring-shaped stator which possesses sharpedged orifices and baffles.

EXAMPLE A 3,000 parts of tetrahydrofuran were added, whilst stirring, to a solution, of viscosity 34,600 cP, comprising 220 parts of poly (amide-imide) resin, which had been prepared by the above procedure, in 780 parts of 1-methyl-2-pyrrolidone.

The poly(amide-imide) solution obtained was introduced via a pipeline 7, by means of a metering pump, into the precipitation medium, namely water, in the immediate vicinity of the rotor 4. At the same time, about a 20-fold amount by volume of water was fed to the machine via the feed nozzle 2. The fibrid suspension discharged at the outlet nozzle 3 was conveyed to a collecting vessel. The fibrids accumulated at the surface and were skimmed off. They were then drained on a suction filter and washed thereon, with water, until the residue was free from tetrahydrofuran and 1-methyl-2-pyrrolidone. The fibrids obtained were very finely fibrillated.

The following properties of the fibrids were measured:

| | |
|---|---|
| Length | from 0.2 to 1.0 mm |
| Thickness | from 10 to 50 μm |
| Water content | 94.1% |
| Freeness | 74 ° SR |
| Draining time | 165 sec. |
| Specific surface area | 50.8 $m^2/g$. |

EXAMPLE B 2,705 parts of tetrahydrofuran are added, whilst stirring, to a solution, of viscosity 34,600 cP, comprising 285 parts of poly(amide-imide) resin, which has been obtained according to the above procedure in 1,010 parts of 1-methyl-2-pyrrolidone. The process of manufacture and the working up were carried out as described in Example A.

The following properties of the fibrids were measured:

| | |
|---|---|
| Length | from 0.1 to 1.2 mm |
| Thickness | from 20 to 80 μm |
| Water content | 91.9% |
| Freeness | 32 ° SR |
| Draining time | 28 sec. |
| Specific surface area | 34.4 $m^2/g$ |

The fibrids obtained according to Examples A and B were used in the following Examples.

EXAMPLE 1

From the fibrids obtained as described in Example A, it is possible to produce sheets weighing 1 g and 2.4 g (standard sheet) on a laboratory sheet-forming apparatus (Rapid-Köthen); the sheets were easily removable from the wire. Sheets produced from 100% of the fibrids manufactured according to the invention exhibited a uniform formation and good fiber bond. An initial wet strength of 373 g was measured on the standard sheet.

EXAMPLE 2

Manufacture of a Mixed Paper from Fibrids and Cellulose

A standard sheet was obtainable from 70 parts of fibrids, which had been manufactured as described in Example A, and 30 parts of sulfite cellulose having a freeness of 35 ° SR; this sheet was again easily removable from the wire and exhibited a uniform formation and a good fiber bond. The measured wet strength was 312 g.

EXAMPLE 3

Standard sheets, which were easily removable from the wire, were produced, on a laboratory sheet-forming apparatus, from fibrids obtained as described in Example B. The sheets exhibited a uniform formation and a good fiber bond. The measured initial wet strength was 400 g.

It was found that the sheet could be drained more rapidly than the standard sheet produced in Example 1 (draining time: 28 seconds against 165 seconds).

EXAMPLE 4

Manufacture of a Mixed Paper from Fibrids and Synethetic Staple Fibers

Staple fibers of an aromatic poly(amide-imide) (staple length: 8 mm, 2–3 dtex) were suspended in water, together with fibrids which had been obtained as described in Example A, and standard sheets, which were once again easily removable from the wire, were produced on the laboratory sheetforming apparatus. The sheets exhibited uniform distribution of the staple fibers and good cohesion even if the proportion of staple fibers was as much as 90%.

| Proportion of staple fibers % | Proportion of fibrids % | Tear length m | Elongation at break % |
|---|---|---|---|
| — | 100 | 2,500 | 4 |
| 30 | 70 | 2,300 | 3.5 |
| 50 | 50 | 2,100 | 3 |
| 70 | 30 | 1,800 | 2 |
| 80 | 20 | 1,400 | 1.5 |
| 90 | 10 | 900 | 1.5 |

Burning tests carried out in accordance with DIN 53,906 and 53,907 showed that these materials are non-flammable.

We claim:

1. A process for the manufacture of paper-like and textile-like sheets, which have an initial wet strength of at least 80 g, which comprises suspending fibrids in water, and applying the suspension of said fibrids to a paper-forming machine or a wet-laid, non-woven machine to form a coherent self-supporting web of said fibrids thereon, at least a portion of said fibrids having been manufactured by dissolving a poly(amide-imide) resin in an organic solvent and introducing the resulting solution into water while at the same time exposing it to shearing forces, in which process the solution of the poly(amide-imide) resin in an organic solvent is mixed, before its introduction into water, with a liquid in a volume ratio of said solvent to said liquid of from 1:1.5 to 1:5, said liquid being a non-solvent for the poly(amide-imide) resin but being homogeneously miscible in all proportions with water and with the organic solvent, and which liquid is selected from the group consisting of tetrahydrofurane and 1,4 dioxane, and which fibrids have a length of from 0.1 to 5 mm, a thickness of from 2 to 200 μm, a freeness of from 20 to 90° SR and a specific surface area of from 1 to 80 $m^2/g$.

2. A process as claimed in claim 1 wherein said fibrids consist essentially of fibrids of said poly(amide-imide) resin.

3. A process as claimed in claim 1 wherein said fibrids are fibrids of said poly(amide-imide) resin in admixture with pulp and/or other natural or synthetic fibrous materials.

4. A process as claimed in claim 1, wherein said poly(amide-imide) resin contains recurring units of the formula

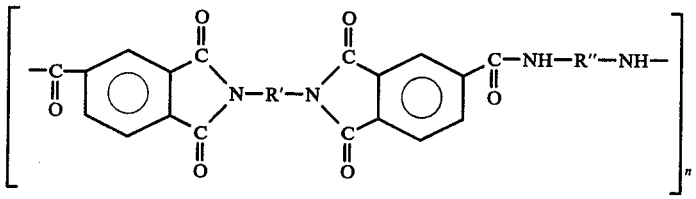

where $n$ is an integer, R′ and R″ are identical or different and respectively are m-phenylene, p-phenylene, or

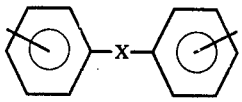

and $x$ is $CH_2$, O, S, CO or $SO_2$, said resin optionally containing additional amide linkages of the formula

—OC—R′—CO—NH—R″—NH— in which R′ and R″ have the aforesaid meanings.

5. Paper-like and textile-like sheets, which have an initial wet strength of at least 80 g at a water content of 83% by weight produced by the process of suspending fibrids in water and applying the resultant suspension on a paper-making machine or a wet-laid non-woven machine to form a self-supporting, coherent web, at least part of said fibrids being fibrids of poly(amide-imide) resins produced by dissolving a poly(amide-imide) resin in an organic solvent and introducing the resulting solution into water while at the same time exposing it to shearing forces, in which process the solution of the poly(amide-imide) resin in an organic solvent is mixed, before its introduction into water, with a liquid in a volume ratio of said solvent to said liquid of from 1:1.5 to 1:5, said liquid being a non-solvent for the poly(amide-imide) resin but being homogeneously miscible in all proportions with water and with the organic solvent, and which liquid is selected from the group consisting of tetrahydrofuran and 1,4 dioxane, and which fibrids have a length of from 0.1 to 5 mm, a thickness of from 5 to 200 μm, a freeness of from 20 to 90° SR and a specific surface area of from 1 to 80 $m^2/g$.

6. Paper-like and textile-like sheets as claimed in claim 5 in which said fibrids consist essentially of said poly(amide-imide) resins.

7. Paper-like and textile-like sheets as claimed in claim 5 in which said fibrids comprise fibrids of said poly(amide-imide) resins in admixture with staple fibers of other fiber-forming polymers or with cellulose fibers.

* * * * *